US007909613B2

(12) United States Patent
Lee et al.

(10) Patent No.: US 7,909,613 B2
(45) Date of Patent: Mar. 22, 2011

(54) COAXIAL CONNECTING DEVICE

(75) Inventors: Yong Goo Lee, Songpa-Gu (KR); Maeng Youl Lee, Seoul (KR); Min Su Park, Paldal-gu (KR); Sung Jin Kim, Yongin-Si (KR)

(73) Assignee: Gigalane Co. Ltd., Suwon-si (KR)

( * ) Notice: Subject to any disclaimer, the term of this patent is extended or adjusted under 35 U.S.C. 154(b) by 0 days.

(21) Appl. No.: 12/450,484

(22) PCT Filed: Jan. 8, 2008

(86) PCT No.: PCT/KR2008/000111

§ 371 (c)(1),
(2), (4) Date: Sep. 28, 2009

(87) PCT Pub. No.: WO2008/120856

PCT Pub. Date: Oct. 9, 2008

(65) Prior Publication Data

US 2010/0015849 A1 Jan. 21, 2010

(30) Foreign Application Priority Data

Mar. 29, 2007 (KR) ..... 10-2007-0030670

(51) Int. Cl.
*H01R 12/00* (2006.01)

(52) U.S. Cl. ..... 439/63

(58) Field of Classification Search ..... 439/63, 439/581, 700, 824; 324/754, 761
See application file for complete search history.

(56) References Cited

U.S. PATENT DOCUMENTS 4,588,241 A * 5/1986 Ardezzone ..... 439/581
4,645,288 A * 2/1987 Stursa ..... 439/581
5,175,493 A * 12/1992 Langgard ..... 324/761
5,725,387 A * 3/1998 O'Sullivan et al. ..... 439/98
5,940,966 A * 8/1999 Fasano et al. ..... 29/842
6,053,777 A * 4/2000 Boyle ..... 439/700
6,086,383 A * 7/2000 Fasano et al. ..... 439/63
6,152,743 A * 11/2000 Fox ..... 439/63
6,312,281 B1 * 11/2001 Rodriguez ..... 439/394
6,358,062 B1 * 3/2002 Feldman et al. ..... 439/63
6,386,913 B1 * 5/2002 Mohammad et al. ..... 439/579
6,992,544 B2 * 1/2006 Barnes et al. ..... 333/33
7,097,460 B2 * 8/2006 Clark et al. ..... 439/63
7,597,588 B1 * 10/2009 Hyzin et al. ..... 439/578

(Continued)

*Primary Examiner* — T C Patel
*Assistant Examiner* — Vladimir Imas
(74) *Attorney, Agent, or Firm* — The Nath Law Group; Jerald L. Meyer; Sungyeop Chung

(57) ABSTRACT

A coaxial connecting device is provided for making an electrical connection between a coaxial cable and a device under test. A coaxial connecting device electrically connects a coaxial cable to a signal pad and a ground pad. The coaxial contractor of the present invention includes a signal pin for electrically connecting a signal conductor of the coaxial cable to the signal pad; a ground connector for electrically connecting a ground conductor of the coaxial cable to the ground pad; a cylindrical guide tube surrounding the ground conductor for elastically contacting the ground connector while maintaining a predetermined distance with the signal pin; and a dielectric member surrounding a part of the signal pin for electrically isolating the cylindrical guide tube and the signal pin from each other and coaxially maintaining the guide tube and the signal pin. The coaxial connecting device of the present invention minimizes a contact path between the ground conductor of a coaxial cable and a ground pad and provides impedance matched coaxial signal transmission link, resulting in improvement of frequency characteristics.

14 Claims, 4 Drawing Sheets

U.S. PATENT DOCUMENTS

2004/0002232 A1* 1/2004 Johnson, Jr. ..... 439/63
2005/0079771 A1* 4/2005 DeLessert et al. ..... 439/700
2006/0172561 A1* 8/2006 Clark et al. ..... 439/63
2008/0085632 A1* 4/2008 Benham ..... 439/579
2009/0176406 A1* 7/2009 Yaghmai et al. ..... 439/581
2010/0015849 A1* 1/2010 Lee et al. ..... 439/578

* cited by examiner

[Fig. 1]
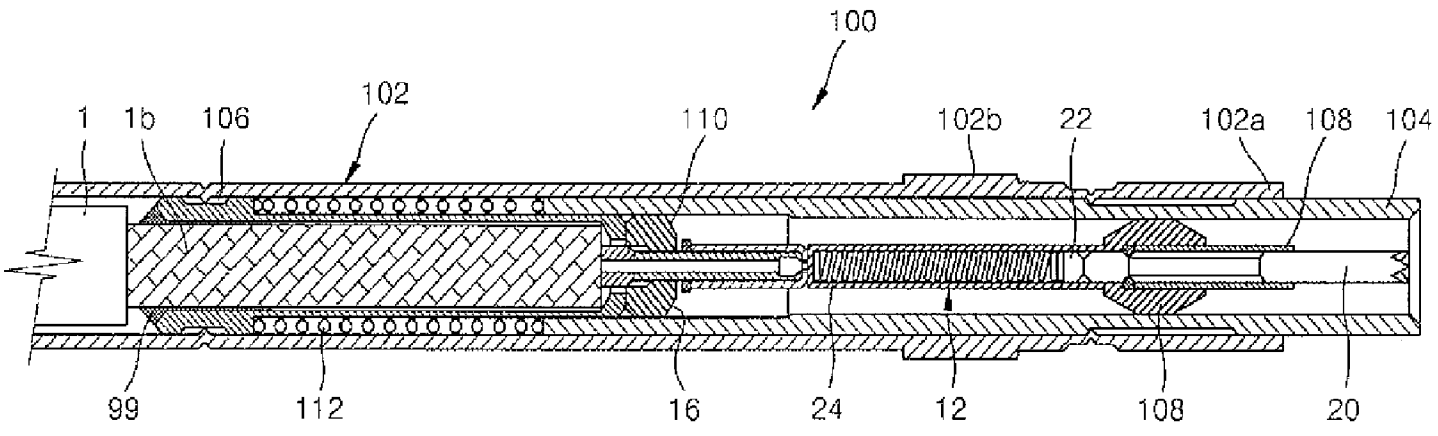
PRIOR ART

[Fig. 2]
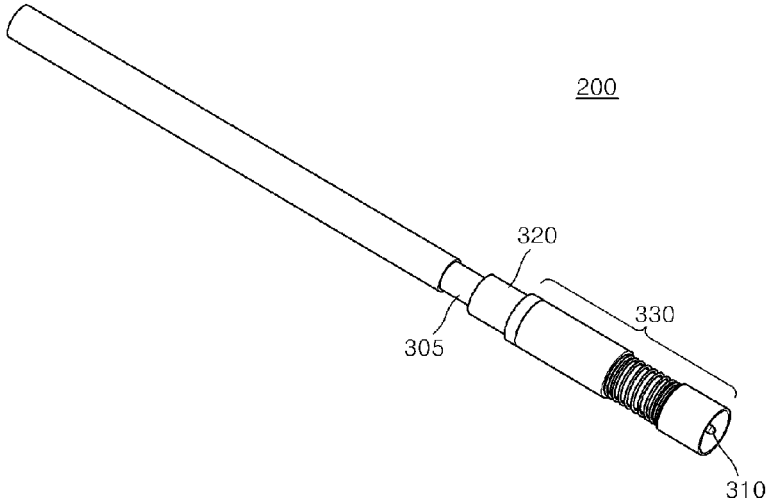
[Fig. 3]
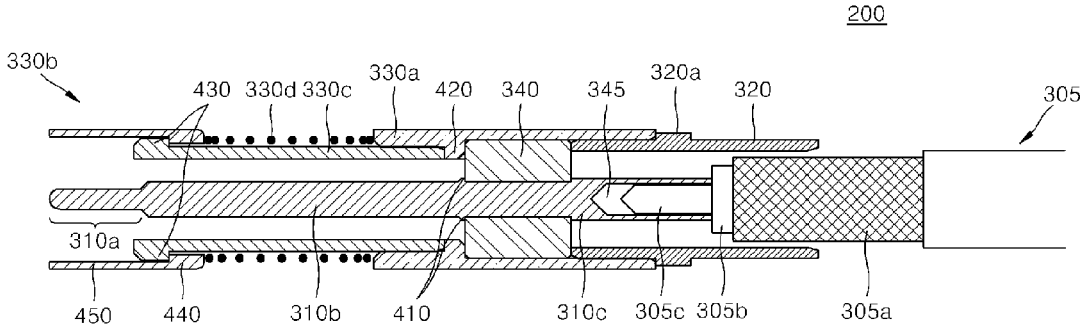
[Fig. 4]
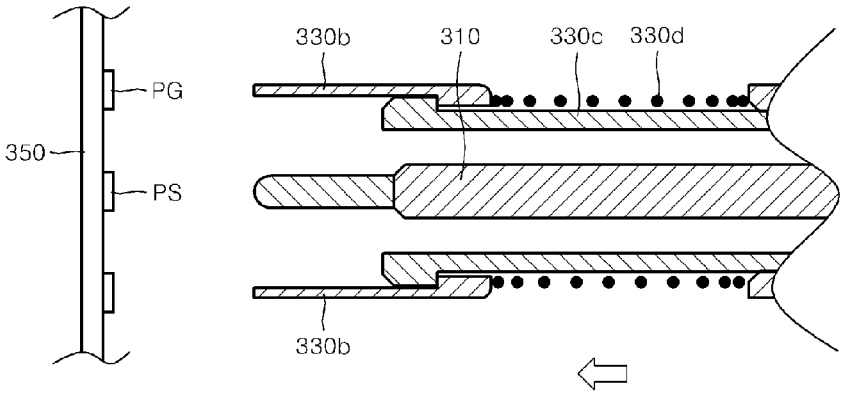

[Fig. 5]
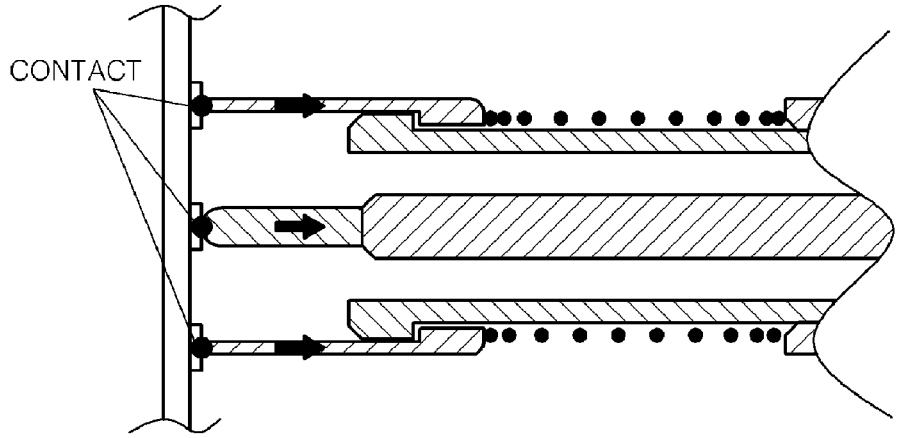
[Fig. 6]
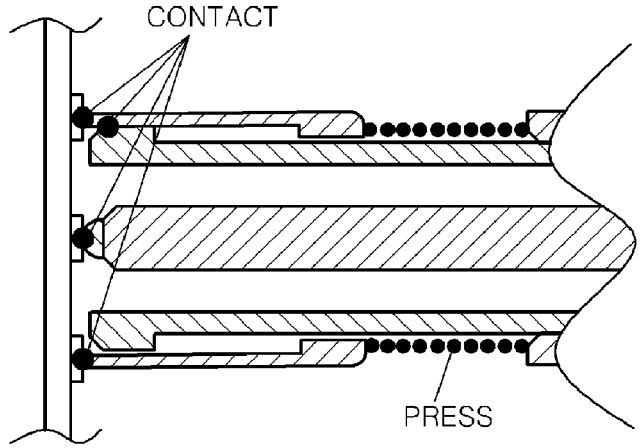
[Fig. 7]
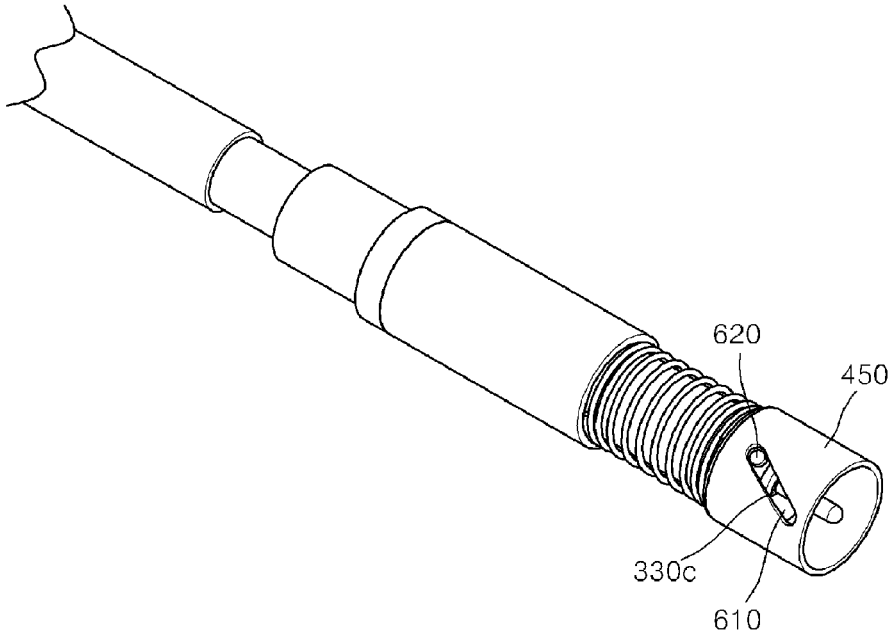

[Fig. 8]
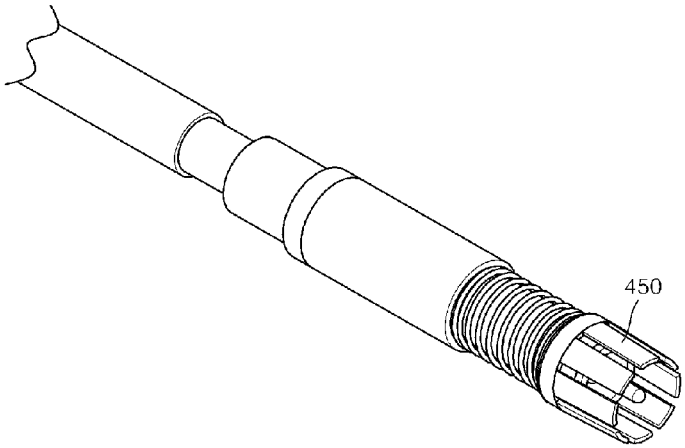
[Fig. 9]
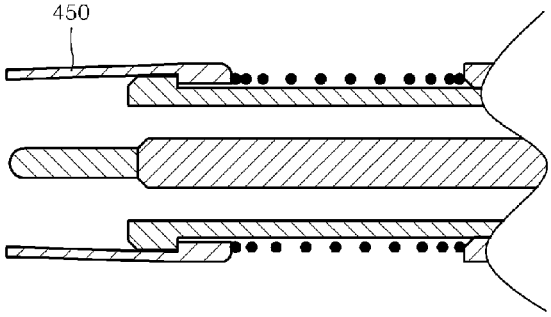
[Fig. 10]
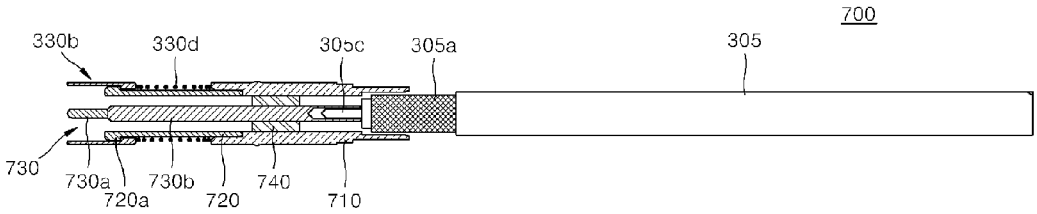

COAXIAL CONNECTING DEVICE

TECHNICAL FIELD

The present invention relates to a coaxial connecting device and, in particular, to a coaxial connecting device for making an electrical connection between a coaxial cable and a device under test.

BACKGROUND ART

Coaxial cable is an electrical cable consisting of an inner signal conductor, an insulator surrounding the signal conductor, and an outer cylindrical conducting shield surrounding the insulating spacer such that the inner conductor and the outer shield shares the same axis.

The coaxial cable is often used for precise electric and electronic devices and test devices due to its low electrical interference and transmission stability relative to other types of cables. In a case of usage with a test device, a coaxial connecting device for securing signal transmission reliability of the coaxial cable even with repeated attachment and detachment to the test objects.

FIG. 1 shows a conventional coaxial connecting device. As shown in FIG. 1, the conventional coaxial connecting device includes an inner conductive contact assembly contacting a signal conductor of a coaxial cable, a conductive ground plunger containing the inner conductive contact assembly in its cylindrical inner space, an isolator for electrically isolating the inner conductive contact assembly and the conductive ground plunger from each other, and an interface element fixed to an outer conductor of a coaxial cable so as to make electrical connection to the plunger. The interface element is arranged in an exterior barrel by means of a ground sleeve such that the ground sleeve slides along the interface element fixed inside the exterior barrel.

In the conventional coaxial connecting device, however, the interface element is fixed on the exterior barrel such that, when approaching the exterior barrel to a test object without cutting off the electricity on the coaxial cable, the contact assembly and ground plunger are likely to contact the conductors of the test object before fixing the exterior barrel in place so as to cause unstable electric current, whereby it is required to laboriously switch on and off the electricity whenever changing test target devices.

Meanwhile, a connection member is required for electrically connecting the test equipment, which generates test signals, to a test target device. Particularly, as the devices to be tested are highly advanced, the connection link vulnerable to weak signals and interferences causes to degrade the test result reliability.

Therefore, there has been a requirement for a coaxial connecting device capable of transferring test signals to test target device, without degrading the signal strength and causing frequency interferences.

DISCLOSURE OF INVENTION

Technical Problem

The present invention has been made in an effort to solve the above problems, and it is an object of the present invention to provide a coaxial connecting device that is capable of minimizing the signal contact path between a coaxial cable and an external pad and reducing signal loss and interference.

Technical Solution

In one aspect of the present invention, the above and other objects of the present invention are accomplished by a coaxial connecting device electrically connecting a coaxial cable to a signal pad and a ground pad. The coaxial connecting device includes a signal pin for electrically connecting a signal conductor of the coaxial cable to the signal pad; a ground connector for electrically connecting a ground conductor of the coaxial cable to the ground pad; a cylindrical guide tube surrounding the ground conductor for elastically contacting the ground pad while maintaining a predetermined distance with the signal pin; and a dielectric member surrounding a part of the signal pin for electrically isolating the cylindrical guide tube and the signal pin from each other and coaxially maintaining the guide tube and the signal pin.

Preferably, the ground connector is directly connected to the ground conductor of the coaxial cable at one end and tightly inserted into the cylindrical guide tube, the ground connector having a first protrusion.

Preferably, the cylindrical guide tube includes a main body connected to an end of the ground connector by means of shrink fit and fixed by the first protrusion; a ground contact part elastically connected to the ground pad; a bridge part electrically connecting the ground contact part to the main body; and an elastic member arranged between the main body and the ground contact part, the elastic member surrounding the bridge part.

Preferably, the signal pin is a spring probe pin.

Preferably, the signal pin includes a first part which is elastically contacting with the signal pad; a second part longitudinally connected to a proximal end of the first part and having a fixation protrusion for limiting movement of the dielectric member, the second part being formed with a diameter larger than that of the first part such that the first part reciprocates within the second part; and a third part longitudinally connected to the second part at one end and having an insertion hole formed at the other end for receiving the signal conductor, the third part having a diameter larger than that of the second part.

Preferably, the second part is arranged such that a beginning end of the second part is positioned below a finishing end of the bridge part of the cylindrical guide tube.

Preferably, the main body has a second protrusion protruded inward for limiting movement of the dielectric member in cooperation with the fixation protrusion and limiting a movement of the bridge member; the bridge member is connected to the main body at one end by means of shrink fit and fixed by the second protrusion and is provided with a third protrusion at the other end for defining movement of the ground contact part; and the ground contact part includes a stopper for restricting movement of the ground contact part and an elongate member for maintaining electrical contact with the third protrusion while the ground contact part reciprocates along the bridge part.

Preferably, the elongate member has a cylindrical shape of which inner surface is electrically contacting with the third protrusion.

Preferably, the elongate member has a cylindrical shape having a guide hole elongated in a longitudinal direction, the guide hole being slightly skewed relative to a longitudinal axis of the coaxial connecting device and the bridge part has an engagement pin which is engaged with the guide hole, the engagement of the engagement pin and the guide hole providing electrical contact point.

Preferably, the elongate member has a cylindrical shape tapered to a distal end and slit in a longitudinal direction with predetermined intervals along its circumference, the elongate member electrically contacting the third protrusion while moving back and forth.

Preferably, the dielectric member is blocked to move in a direction by the second protrusion of the main body and the fixation protrusion and in the other direction by an end of the ground connector and the third part, and the signal pin and the cylindrical guide tube are isolated from each other by the dielectric member and space in between.

Preferably, the ground connector is directly connected, at its one end, to the ground conductor of the coaxial cable and has a connection protrusion formed on its inner wall for fixing the cylindrical guide tube inside thereof; and the cylindrical guide tube comprises a ground contact part which is elastically contacting with the ground pad, a bridge part connected to the ground contact part by means of shrink fit and fixed by the connection protrusion and electrically connecting the ground contact part and to the ground connector, and an elastic member interposed between the ground contact part and the ground connector and surrounding the bridge part.

Preferably, the signal pin includes a first part which is elastically contacting with the signal pad; and a second part which a diameter larger than that of the first part and is connected to the first part at one end and has a insertion hole formed at the other end for receiving the signal conductor of the coaxial cable, the one end of the second part being positioned below one end of the bridge part of the cylindrical guide tube.

Preferably, the bridge part of the cylindrical guide tube is connected to the ground connector at one end by means of shrink fit and fixed by the fixation protrusion, limits movement of the ground contact part by biasing force of the elastic member, and has a contact protrusion protruded on an outer surface thereof; and the ground contact part comprises a stopper facing one end of the elastic member and an elongate member integrally formed with the stopper and maintaining electrical contact with the contact protrusion while the ground contact part moves back and forth.

Preferably, the dielectric member is connected to the second part of the signal pin by means of shrink fix, and the signal pin and the cylindrical guide tube are electrically isolated from each other by the dielectric member and space formed between the signal pin and the cylindrical guide tube.

ADVANTAGEOUS EFFECTS

The coaxial connecting device of the present invention has an effect to minimize contact path between the ground conductor of a coaxial cable and a ground pad of a device under test, resulting in improvement of impedance match and frequency characteristics.

BRIEF DESCRIPTION OF THE DRAWINGS

The above and other objects, features and advantages of the present invention will be more apparent from the following detailed description in conjunction with the accompanying drawings, in which:

FIG. 1 is a perspective view illustrating a conventional coaxial connecting device;

FIG. 2 is a perspective view illustrating a coaxial connecting device according to an exemplary embodiment of the present invention;

FIG. 3 is a cross sectional view illustrating the coaxial connecting device of FIG. 2;

FIGS. 4 to 6 are partial cross sectional views illustrating how to operate the coaxial contractor of FIG. 1;

FIG. 7 is a perspective view illustrating a coaxial connecting device according to another exemplary embodiment of the present invention;

FIG. 8 is a perspective view illustrating a coaxial connecting device according to an exemplary embodiment of the present invention;

FIG. 9 is a partial cross sectional view of the coaxial connecting device of FIG. 8; and FIG. 10 is a cross sectional view illustrating a coaxial connecting device according to another exemplary embodiment of the present invention.

BEST MODE FOR CARRYING OUT THE INVENTION

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

FIG. 2 is a perspective view illustrating a configuration of a coaxial connecting device according to an exemplary embodiment of the present invention.

In this embodiment, the present invention is a coaxial contractor 200 for electrically connecting a signal pad and a contact pad of an external printed circuit board (not shown) to a coaxial cable 305. As shown in FIG. 2, the coaxial connecting device according to an embodiment of the present invention includes a signal pin 310, a ground connector 320, a cylindrical guide tube 330, and a dielectric member (not shown).

If a pressure is applied while the guide tube 330 and signal pin 310 are contact the respective ground and signal pads, the guide tube 330 and the signal pin 310 are elastically compressed. The guide tube 330 is connected to a ground and functions as a ground, and the signal pin 310 is connected to a signal conductor (not shown) of the coaxial cable 305.

FIG. 3 is a cross sectional view illustrating the coaxial connecting device of FIG. 2, and FIGS. 4 to 6 are partial cross sectional views illustrating how to operate the coaxial contractor of FIG. 1. A structure and function of the coaxial connecting device of the present invention is described hereinafter with reference to FIGS. 2 to 6.

A coaxial cable 305 includes a signal conductor 305*c*, a dielectric insulator 305*b* surrounding the signal conductor 305*c*, and a ground conductor 305*a* surrounding the dielectric insulator 305*b*. The signal pin 310 of the coaxial connecting device is elastically contacting with a signal pad (PS) of an external printed circuit board (PCB) 350 so as to make an electrical connection between the signal conductor 305 of the coaxial cable 305 and the signal pad (PS).

The signal pin 310 can be any of a variety of materials that are conductive to transfer electrical signals. The signal pin 310 is configured such that the tip of the signal pin 310 is contracted and extended.

The signal pin 310 includes a first part 310*a*, a second part 310*b*, and a third part 310*c* formed with different diameters. The first part 310*a* can elastically reciprocate in longitudinal direction against the signal pad (PS).

The second part 310*b* is connected at one end of the first part 310*a* such that the first part 310*a* reciprocates inside the second part 310*b*. The second part 310*b* is also provided with a fixation protrusion 410 formed around an outer surface at one end for fixing the dielectric member 340. The third part 310*c* is connected at the other end of the second part such that the second part 310*b* is fixed inside of the third part 310*c*. The third part 310*c* is provided with a contact hole 345 at the other end for tightly receiving the signal conductor 305*c* of the coaxial cable 305. The third part 310*c* has a diameter larger than that of the second part 310*b* so as to fixedly contact with the dielectric member.

The signal conductor 305*c* of the coaxial cable 305 is inserted into the contact hole 345 of the third part 310*c* of the signal pin 310 and then fixed by means of soldering. Although the soldering is used in this embodiment, the signal conductor 305*c* and the signal pin 310 can be abutted with each other using various techniques.

The ground connector 320 surrounds a part at which the signal pin 310 and the coaxial cable 305 are connected to each other. The ground connector 320 is connected to the ground conductor 305*a* of the coaxial cable 305. The ground connector 320 is directly connected to the ground conductor 305 of the coaxial cable 305 by surrounding the ground conductor 305 such that the entire cylindrical guide tube 330 functions as a ground.

The ground connector 320 has a shape of a cylindrical sleeve having a protrusion 320*a* formed around its outer circumferential surface. One end of the ground connector 320 is connected to the ground conductor 305*a* of the coaxial cable 305 and the other end of the ground connector 320 is connected to the guide tube 330.

The dielectric member 340 is arranged to contacted with the ground connector 320 around the signal pin 310. The dielectric member 340 surrounds at a part of the signal pin 310 so as to electrically insulate the signal pin 310 from the guide tube 330 and maintain the guide tube 330 and the signal pin 310 in a concentric manner. The dielectric member 340 is fixed by means of the second protrusion 420 and the first protrusion 410 arranged at one end of the guide tube 330 and one end of the ground connector 320 and the third part 310*c* of the signal pin 310 arranged at the other end.

The signal pin 310 is insulated against the cylindrical guide tube 330 by means of air except for a region surrounded by the dielectric material. The signal pin 310 and the guide tube are isolated from each other by the dielectric member 340 and the air.

A start point of the second part 310*b* of the signal pin 310 is arranged below the upper end of a middle part 330*c* of the guide tube 330. Accordingly, even when the first part 310*a* of the signal pin 310 contacts the signal pad (PS) so as to be retreated, the start point of the second part 310*b* is prevented from directly contacting the signal pad (PS).

The cylindrical guide tube 330 contacts with an outer surface of the ground connector and surrounds the signal pin 310 while maintaining a predetermined distance. Also, the guide tube 330 is elastically contact with the ground pad (PG).

The structure of the cylindrical guide tube 330 is described hereinafter in more detail. The cylindrical guide tube 330 includes a main body 330*a*, a ground contact part 330*b*, a bridge part 330*c*, and an elastic member. The main body 330*a* is coupled with a ground connector 320 by means of shrink fit and fixed by the first protrusion 320*a*. The ground contact part 330*b* is elastically contacted with the ground pad (PG). The bridge part 330*c* is electrically connecting the main body 330*a* and the ground contact part 330*b*. The elastic member 330*d* is arranged between the main body 330*a* and the ground contact part 330*b* by surrounding the bridge part 330*c*.

The main body 330*a* is provided with a second protrusion 420 for fixing the dielectric member 340 with the first protrusion 410 and fixing one end of the bridge part 330*c* at the other side.

The bridge part 330*c* is connected, at its one end, to the main body 330*a* by means of shrink fit and is provided with a third protrusion 430 at the other end for defining movement of the ground contact part 330*b*.

The ground contact part 330*b* includes a stopper 440 which is hooked with the third protrusion 430 to restrict the movement of the ground contact part 330*b* and an elongate member 450 for maintaining the electrical contact with the third protrusion 430 while the ground contact part 330*b* reciprocates along the bridge part 330*c*.

The bridge part 330*c* is connected to the ground contact part 330*b* such that the ground contact part 330*b* can slide along the bridge part 330*c*. The movement of the ground contact part 330*b* is limited by the third protrusion 430 of the bridge part 330*c* and biased by the elastic member 330*d*. The elastic member 330*d* can be any of various types of springs.

The bridge part 330*c* is fixed to the main body 330*a* together with elastic member 330*d* by means of shrink fit and fixed by the second protrusion 420. The coaxial cable 30 coupled with the ground connector 320 and the signal pin 310 is connected to the main body 330*a* by means of shrink fit. The ground connector 320 is fixed to the main body 330*a* by the first protrusion 320*a*.

After the ground connector 320 is connected to the main body 330*a*, the ground conductor 305*a* of the coaxial cable 305 is soldered to the ground connector 320. The elongate member 450 of the ground contact part 330*b* has a cylindrical shape and its inner surface is contacted with the third protrusion so as to maintain the electrical connection, thereby functioning as a ground.

FIG. 4 shows a state of the coaxial connecting device 200 before contacting with a device on the PCB 350 to be tested; FIG. 5 shows a state of the coaxial connecting device 200 contacting with a device on the PCB 350 to be tested; and FIG. 6 shows a state of the coaxial connecting device 200 when the coaxial contractor 200 is pressed to the PCB 350 such that the first part 310*a* of the signal pin 310 and the elongate member 450 of the ground connect part 330*b* are elastically withdrawn.

The elongate member 450 maintains the contact with the third protrusion 430 of the bridge part 330*c* while being withdrawn. That is, when the coaxial connecting device 200 is pushed to the PBC 350, the ground contact part 330*b* is biased by the elastic member 330*d* so as to be tightly contacted with the ground pad (PG) while the elongate member 450 is maintaining the electrical connection with the third protrusion 430.

Since the elongate member 450 is connected to the ground conductor 305*a* of the coaxial cable 305, it functions as a ground. Also, the signal pin 310 is electrically connected to the signal conductor 305*c* of the coaxial cable 305 so as to make a signal line.

FIG. 7 is a perspective view illustrating a coaxial connecting device according to another exemplary embodiment of the present invention.

Referring to FIG. 7, an elongate member 450 of the ground contact part 330*b* is formed having a cylindrical shape. The elongate member 450 is provided with a guide hole 610 elongated in its longitudinal direction, the guide hole 610 being slightly skewed relative to a longitudinal axis of the coaxial connecting device 200.

The guide hole 610 receives an engagement pin 620 formed on the surface of the bridge part 330 such that the elongate member 450 is rotatively reciprocating.

The contact point of the bridge part 330 and the elongate member 450 is established by the guide hole 610 and the engagement pin 620 such that the elongate member 450 contacts the contact pad (PG) with low contact resistance.

FIG. 8 is a perspective view illustrating a coaxial connecting device according to an exemplary embodiment of the present invention, and FIG. 9 is a partial cross sectional view of the coaxial connecting device of FIG. 8.

Referring to FIG. 8, the elongate member 450 has a cylindrical shape tapered to its distal end and slit in a longitudinal direction along its circumference with regular intervals, whereby the distal end can be leaned inward.

The inner wall of the slit elongate member 450 is electrically contacted with the third protrusion 430 such that multiple contact points secure contact stability.

FIG. 10 is a cross sectional view illustrating a coaxial connecting device according to another exemplary embodiment of the present invention.

As shown in FIG. 10, the coaxial connecting device 700 is provided with a ground connector 710 and a signal pin 730 that are different from those of coaxial connecting device of FIG. 3. Detailed descriptions of functions and structures of other elements are omitted.

The ground connector 710 is directly connected, at its one end, to the ground conductor 305*a* of the coaxial cable and is provided with an engagement protrusion formed on an inner surface thereof for fixing a bridge part 720 of a cylindrical guide tube.

The cylindrical guide tube includes a ground contact part 330*b* which is elastically contacting with a ground pad, a bridge part 720 coupled with the ground connector 710 by means of shrink fit and fixed by a fixation protrusion so as to make an electrical connection to the ground contact part 330*b*, and an elastic member 330*d* arranged between the ground contact part 330*b* and the ground connector 710, the elastic member 330*d* winding the bridge part 720.

As shown in FIG. 7, the ground connector 710 of the coaxial connecting device 700 has a shape formed by integrating the ground connector 320 with the main body 330*a* of the coaxial connecting device of FIG. 3.

The signal pin 730 includes a first part 730*a* and a third part 730*c* formed with different diameters. The first part 730*a* can elastically reciprocate in longitudinal direction against the signal pad (PS). The second part 730*b* is connected at one end of the first part 730*a* such that the first part 730*a* can reciprocate inside the second part 730*b*. The second part 730*b* is provided with a hole formed at its other end for receiving the signal conductor 305*c*.

The signal pin 730 has no fixation protrusion, which is provided in FIG. 3 for fixing the dielectric member since there is no third part. A dielectric member 740 is coupled with the second part 730*b* by means of shrink fit. Also, the ground connector 710 has no protrusion for fixing the dielectric member 740.

The bridge part 720 and the ground contact part 330*b* of the cylindrical guide tube are identical with those of FIG. 3 in structures and functions. The protrusion 720*a* of the bridge part 720 is identical with the third protrusion 430 of FIG. 3.

In the coaxial connecting device 700 of FIG. 10, the signal pin 730 and the cylindrical guide tube are isolated from each other by means of the dielectric member and air.

Unlike the coaxial connecting device 200 of FIG. 3 in which the dielectric member is fixed by means of protrusions provided on the cylindrical guide tube and the signal pin, the dielectric member of the coaxial connecting device 700 of FIG. 10 is fixed by means of shrink fit.

Although not depicted in the drawings, it is obvious to those in the art that the protrusion for fixing the dielectric member can be provided on at least one of an inner wall of the cylindrical guide tube and surface of the signal pin.

Although exemplary embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

As described above, the coaxial connecting device of the present invention minimizes a contact length between the ground conductor of a coaxial cable and a ground pad and provides impedance matched coaxial signal transmission link, resulting in improvement of frequency characteristics.

INDUSTRIAL APPLICABILITY

The coaxial connecting device of the present invention is applicable to various types of device testing systems.

The invention claimed is:

1. A coaxial connecting device for electrically connecting a coaxial cable to a signal pad and a ground pad, comprising:

a signal pin for electrically connecting a signal conductor of the coaxial cable to the signal pad;

a ground connector for electrically connecting a ground conductor of the coaxial cable to the ground pad;

a cylindrical guide tube surrounding the ground conductor for elastically contacting the ground pad while maintaining a predetermined distance with the signal pin; and a dielectric member surrounding a part of the signal pin for electrically isolating the cylindrical guide tube and the signal pin from each other and coaxially maintaining the guide tube and the signal pin, wherein the ground connector is directly connected to the ground conductor of the coaxial cable at one end and tightly inserted into the cylindrical guide tube, the ground connector having a first protrusion, wherein the cylindrical guide tube comprises: a main body connected to an end of the ground connector by means of shrink fit and fixed by the first protrusion;

a ground contact part elastically connected to the ground pad;

a bridge part electrically connecting the ground contact part to the main body; and an elastic member arranged between the main body and the ground contact part, the elastic member surrounding the bridge part.

2. The coaxial connecting device of claim 1, wherein the signal pin is a spring probe pin.

3. The coaxial connecting device of claim 2, wherein the signal pin comprises:

a first part which is elastically contacting with the signal pad;

a second part longitudinally connected to a proximal end of the first part and having a fixation protrusion for limiting movement of the dielectric member, the second part being formed with a diameter larger than that of the first part such that the first part reciprocates within the second part; and a third part longitudinally connected to the second part at one end and having an insertion hole formed at the other end for receiving the signal conductor, the third part having a diameter larger than that of the second part.

4. The coaxial connecting device of claim 3, wherein the second part is arranged such that a beginning end of the second part is positioned below a finishing end of the bridge part of the cylindrical guide tube.

5. The coaxial connecting device of claim 4, wherein the main body has a second protrusion protruded inward for limiting movement of the dielectric member in cooperation with the fixation protrusion and limiting a movement of the bridge member;

the bridge member is connected to the main body at one end by means of shrink fit and fixed by the second protrusion and is provided with a third protrusion at the other end for defining movement of the ground contact part; and the ground contact part includes a stopper for restricting movement of the ground contact part and an elongate member for maintaining electrical contact with the third protrusion while the ground contact part reciprocates along the bridge part.

6. The coaxial connecting device of claim 5, wherein the elongate member has a cylindrical shape of which inner surface is electrically contacting with the third protrusion.

7. The coaxial connecting device of claim 5, wherein the elongate member has a cylindrical shape having a guide hole elongated in a longitudinal direction, the guide hole being slightly skewed relative to a longitudinal axis of the coaxial connecting device and the bridge part has an engagement pin which is engaged with the guide hole, the engagement of the engagement pin and the guide hole providing electrical contact point.

8. The coaxial connecting device of claim 5, wherein the elongate member has a cylindrical shape tapered to a distal end and slit in a longitudinal direction with a predetermined intervals along its circumference, the elongate member electrically contacting the third protrusion while moving back and forth.

9. The coaxial connecting device of claim 5, wherein the dielectric member is blocked to move in a direction by the second protrusion of the main body and the fixation protrusion and in the other direction by an end of the ground connector and the third part, and the signal pin and the cylindrical guide tube are isolated from each other by the dielectric member and space in between.

10. A coaxial connecting device for electrically connecting a coaxial cable to a signal pad and a ground pad, comprising:

a signal pin for electrically connecting a signal conductor of the coaxial cable to the signal pad;

a ground connector for electrically connecting a ground conductor of the coaxial cable to the ground pad;

a cylindrical guide tube surrounding the ground conductor for elastically contacting the ground pad while maintaining a predetermined distance with the signal pin; and a dielectric member surrounding a part of the signal pin for electrically isolating the cylindrical guide tube and the signal pin from each other and coaxially maintaining the guide tube and the signal pin, wherein the ground connector is directly connected, at its one end, to the ground conductor of the coaxial cable and has a connection protrusion formed on its inner wall for fixing the cylindrical guide tube inside thereof; and wherein the cylindrical guide tube comprises a ground contact part which is elastically contacting with the ground pad, a bridge part connected to the ground contact part by means of shrink fit and fixed by the connection protrusion and electrically connecting the ground contact part and to the ground connector, and an elastic member interposed between the ground contact part and the ground connector and surrounding the bridge part.

11. The coaxial connecting device of claim 10, wherein the signal pin is a spring probe pin.

12. The coaxial connecting device of claim 11, wherein the signal pin comprises:

a first part which is elastically contacting with the signal pad; and a second part which a diameter larger than that of the first part and is connected to the first part at one end and has a insertion hole formed at the other end for receiving the signal conductor of the coaxial cable, the one end of the second part being positioned below one end of the bridge part of the cylindrical guide tube.

13. The coaxial connecting device of claim 12, wherein the bridge part of the cylindrical guide tube is connected to the ground connector at one end by means of shrink fit and fixed by the fixation protrusion, limits movement of the ground contact part by biasing force of the elastic member, and has a contact protrusion protruded on an outer surface thereof; and the ground contact part comprises a stopper facing one end of the elastic member and an elongate member integrally formed with the stopper and maintaining electrical contact with the contact protrusion while the ground contact part moves back and forth.

14. The coaxial connecting device of claim 13, wherein the dielectric member is connected to the second part of the signal pin by means of shrink fix, and the signal pin and the cylindrical guide tube are electrically isolated from each other by the dielectric member and space formed between the signal pin and the cylindrical guide tube.

* * * * *